US005698060A

United States Patent [19]

Long

[11] Patent Number: 5,698,060

[45] Date of Patent: Dec. 16, 1997

[54] WEB BUTT-SPLICING APPARATUS

[75] Inventor: Michael Long, Rochester, N.Y.

[73] Assignee: Eastman Kodak Company, Rochester, N.Y.

[21] Appl. No.: 572,322

[22] Filed: Dec. 14, 1995

[51] Int. Cl.[6] ..... B65H 21/00

[52] U.S. Cl. ..... 156/304.3; 156/157; 156/504; 156/505; 242/553; 242/554.6; 242/555.4; 242/556.1

[58] Field of Search ..... 156/157, 159, 156/304.3, 502, 504, 505; 242/551, 553, 554.2, 554.6, 555.3, 555.4, 556.1

[56] References Cited

U.S. PATENT DOCUMENTS

| | | | |
|---|---|---|---|
| 3,654,035 | 4/1972 | Takimoto | 156/505 |
| 3,717,057 | 2/1973 | Takimoto | 156/502 X |
| 3,939,031 | 2/1976 | Takimoto | 156/505 |
| 4,097,323 | 6/1978 | De Roeck et al. . | |
| 4,234,365 | 11/1980 | Shimizu et al. | 156/504 X |
| 4,363,695 | 12/1982 | Marass . | |
| 4,492,609 | 1/1985 | Blom . | |
| 5,193,759 | 3/1993 | Bigelow et al. | 242/348.4 |
| 5,283,945 | 2/1994 | Bigelow et al. . | |
| 5,356,496 | 10/1994 | Lincoln et al. | 156/504 X |
| 5,443,681 | 8/1995 | Stivani et al. | 156/159 X |

FOREIGN PATENT DOCUMENTS

| | | | |
|---|---|---|---|
| 59-158220 | 9/1984 | Japan | 156/502 |
| 63-31963 | 2/1988 | Japan | 242/555.1 |
| A-1 400 684 | 1/1973 | United Kingdom . | |

*Primary Examiner*—Mark A. Osele
*Attorney, Agent, or Firm*—Clyde E. Bailey, Sr.

[57] ABSTRACT

An apparatus and method for web butt-splicing at high speeds has a series of vacuum drums which sequentially supports an expiring web and a fresh web. Cutting members are provided on each drum which cooperate with the movement of the drums into proximity for cutting the webs forming just-cut ends of both the fresh and expiring webs. The just-cut ends of the web, once in abutting relations, are then transferred to a splicing means and splice tape is applied across a side of the abutting ends thereby forming a spliced web.

19 Claims, 13 Drawing Sheets

WEB BUTT-SPLICING APPARATUS

TECHNICAL FIELD

The invention relates generally to apparatus for splicing flexible materials, such as webs, and the like. More particularly, the invention concerns an apparatus for splicing a leading end of a first web with a trailing end of a second web to form a new continuous web under high speed operating conditions and without the necessity of frequent interruption of the web conveyance process.

BACKGROUND ART

Apparatus for splicing flexible material, such as web, are well known in the art. In a typical apparatus and method for forming butt joints between webs or flexible material the webs are cut while in an overlapping relations to form abutting ends. One end of one of the webs is separated while being conveyed so that the two cut ends to be joined are in abutting relations with one another. Then, splice tape is applied to the abutting ends to form the butt joint. A problem with existing web butt splicers of the type described is that precise splicing at high web velocity, and with thin webs often produces unsatisfactory joints.

U.S. Pat. No. 4,363,695 discloses one such device for splicing together rolls of web. The device includes means for accelerating a new stockroll of film up to the speed of an expiring web while discarding the potentially damaged outer convolutions of the webs. Splicing tape is applied to overlapping end portions of the webs in a rolling motion by entrapping air bubbles between the splicing tape and the webs to be joined so as to avoid weakening the splice.

Other representative devices for splicing web include those disclosed in U.S. Pat. Nos. 3,939,031; 3,654,035; and 3,717,057 and 4,234,365, each of which generally describes devices that attempt to accelerate a new web stockroll (N') to match the velocity of an expiring web (E')over 180 degrees of rotation of a cutting drum (D') having cutting member (C') (Refer to prior art illustration in FIG. 1). It is our belief that the aforementioned devices are not capable of efficient operations at very high web velocities (i.e., greater than about 100 ft./min.) because there is such a limited time to accelerate a large web stockroll without the necessity of a film reserve device positioned between the stockroll and the splicer or between the splicer and the continuous downstream process. A further shortcoming of the above-identified type splicing devices is that they require that a new web stockroll be loaded onto a turreting unwind as illustrated, for instance in Takimoto, U.S. Pat. No. 3,717,057, Blom, U.S. Pat. No. 4,492,609 and De Roeck, U.S. Pat. No. 4,097,323. Alternatively, prior an devices use a non-driven, displaceable unwind such that the new web is always presented to the splicing apparatus in one and only one position.

The aforementioned shortcomings presented by existing splicing apparatus are solved with an important feature of our device wherein a fresh web is alternately presented to the splicing apparatus in either of two positions in the conveyance process. This capability eliminates the need for space consuming and costly turreted unwinds, taught in the above references. Also, this novel feature of the present invention is especially useful with webs having light sensitive emulsion coatings or which require a high degree of cleanliness in that it enables the use of web stockroll delivery systems using closed cassettes such as the one described in Bigelow, U.S. Pat. No. 5,193,759, hereby incorporated herein by reference. An obvious advantage of closed cassettes is that they house and protect the sensitive webs from light and dust damage and the like. Moreover, since closed cassettes provide limited access to the film, the use of additional devices, such as turrets and displaceable unwinds, is precluded.

Therefore, there persists a need for an efficient web butt-splicer capable of operating at high web speeds in an environment substantially free of contaminants, such as damaging dust and light, and which does not require frequent downtime associated with changing web feed stockrolls.

SUMMARY OF THE INVENTION

An object of the present invention is, for example, to provide an apparatus for splicing abutting ends of webs substantially free of a gap or overlap.

Another object of the present invention is, for example, to provide an apparatus for alternatingly feeding rolls of webs into one of two conveyance arrangements and ultimately splicing just-cut ends of both webs without having to interrupt the conveyance process.

It is a feature of the invention that a just cut trailing end of an expiring web is moved into abutting alignment with a fresh cut lead end of a fresh web where the two ends of the webs are joined without interrupting the conveyance process.

To accomplish these and other objects and advantages of the invention, there is provided, in one aspect of the invention, an apparatus for splicing a first, expiring web to a second, fresh web, comprising a first, ported, full circumference vacuum drum and a second, ported, full circumference vacuum drum which is capable of being urged toward the first drum. Further, the apparatus includes means for supplying the expiring web to one of the first and second vacuum drums as well as means for supplying the fresh web to another of the first and second vacuum drums. With respect to both webs at the end of a splicing cycle (defined below), the first and second vacuum drums are enabled to transport in alternating sequence the other of the expired and fresh webs.

Additionally, a first cutting member is mounted on one of the first and second vacuum drums in a portion of a circumference of the drum where vacuum is applied. Similarly, a second cutting member is mounted on the other of the first and second vacuums drums in a portion of a circumference of the drum where vacuum is applied. The cutting members are capable of cooperating with one another for cutting the webs. Still further, the apparatus includes a third, full circumference vacuum drum and a fourth, at least partial circumference vacuum drum. Means for applying a first strip of splice tape to the third drum is also provided. Moreover, means are provided for moving the first and second drums into proximity to cause the first and second cutting members to cooperate for cutting the first and second webs between the first and second drums, whereby a just-cut leading end of the expiring web remains with one of the first and second vacuum drums and a just-cut trig end of the fresh web remains with the other of the first and second vacuum drums.

The splicing apparatus also includes means cooperating with the moving means, as described above, for causing a just-cut trailing end of the expiring web and a just-cut leading end of the fresh web to transfer from the first drum to the fourth drum. Finally, this embodiment of the invention includes means for moving the third and fourth drums into proximity to cause the first strip of splice tape to be applied across the trailing end of the expiring web and leading end of the fresh web, to form a spliced web.

In another aspect of the invention, a method of butt-joining webs comprises the steps of providing elements including a first and second vacuum drum for supporting the web and providing first and second cutting members, each being mounted on the first and second vacuum drums, respectively, in a portion of the circumference where vacuum is applied, each element as described above. Further, the step of supplying an expiring web to one of the first and second vacuum drums and supplying a fresh web to another of the first and second drum is included in the invention. The first and second drums are moved into proximity to cause the first and second cutting members to cooperate to form a just-cut leading end and a just-cut trailing end of the webs. Moreover, the trailing end of the just cut expiring web and the leading end of said just cut fresh web are moved in abutting alignment for subsequent joining. Splicing tape is provided for engageably joining the ends of the webs into abutting alignment The just-cut leading end of the expiring web, and alternately the just cut trailing end of the fresh web are deflected away from the splicing tape so as to provide easy access to one side of the ends of the webs to be joined. Then, a first strip of splice tape is applied across one side of the trig end of the expiring web and the leading end of the fresh web thereby forming a spliced web.

BRIEF DESCRIPTION OF THE DRAWINGS

The foregoing and other objectives, features and advantages of the invention will be apparent from the following more particular description of the preferred embodiments of the invention, as illustrated in the accompanying drawings.

DESCRIPTION OF THE PREFERRED EMBODIMENTS

Figure 2:
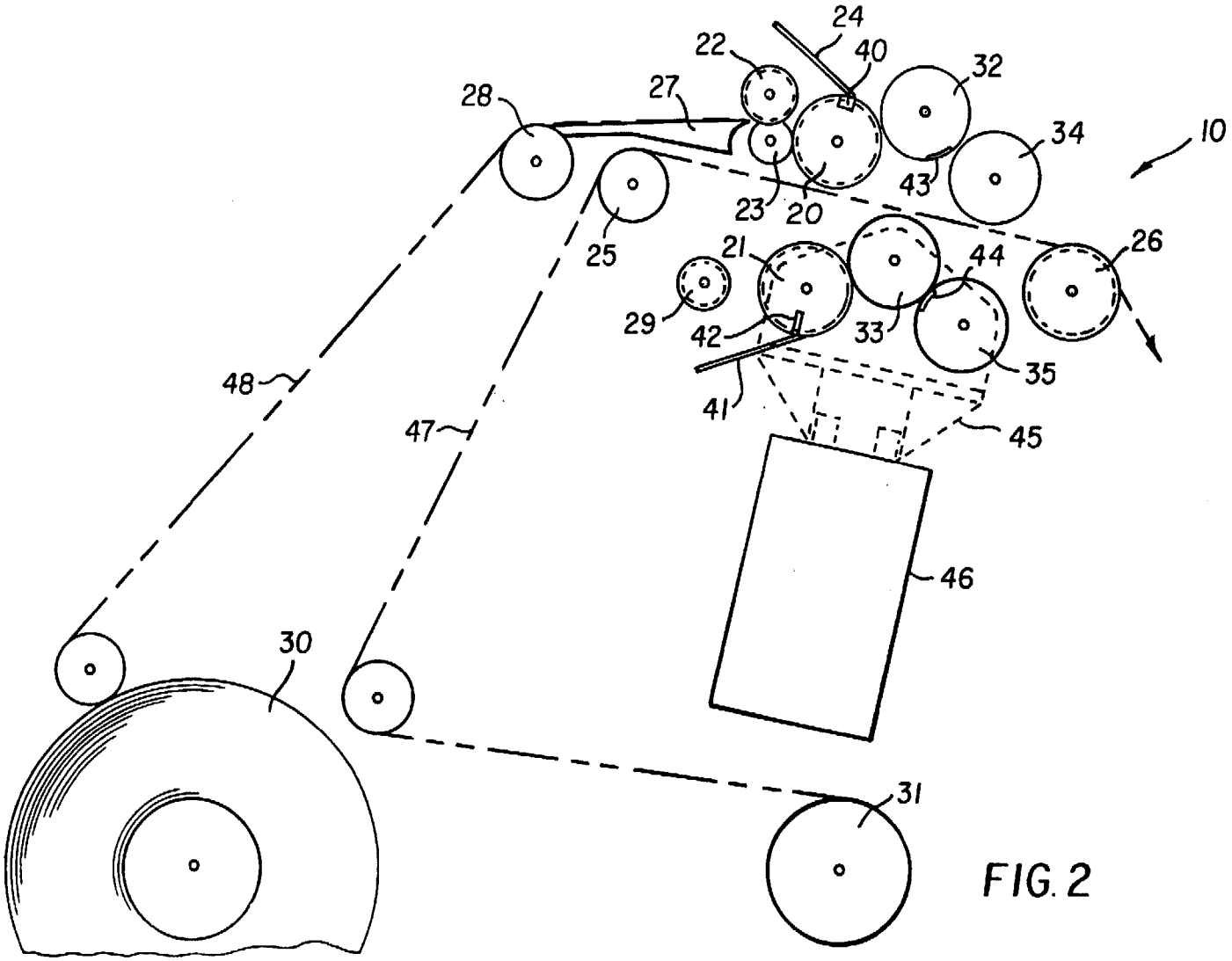
FIG. 2 is a side elevation view of the apparatus of the invention.
Figure 3:
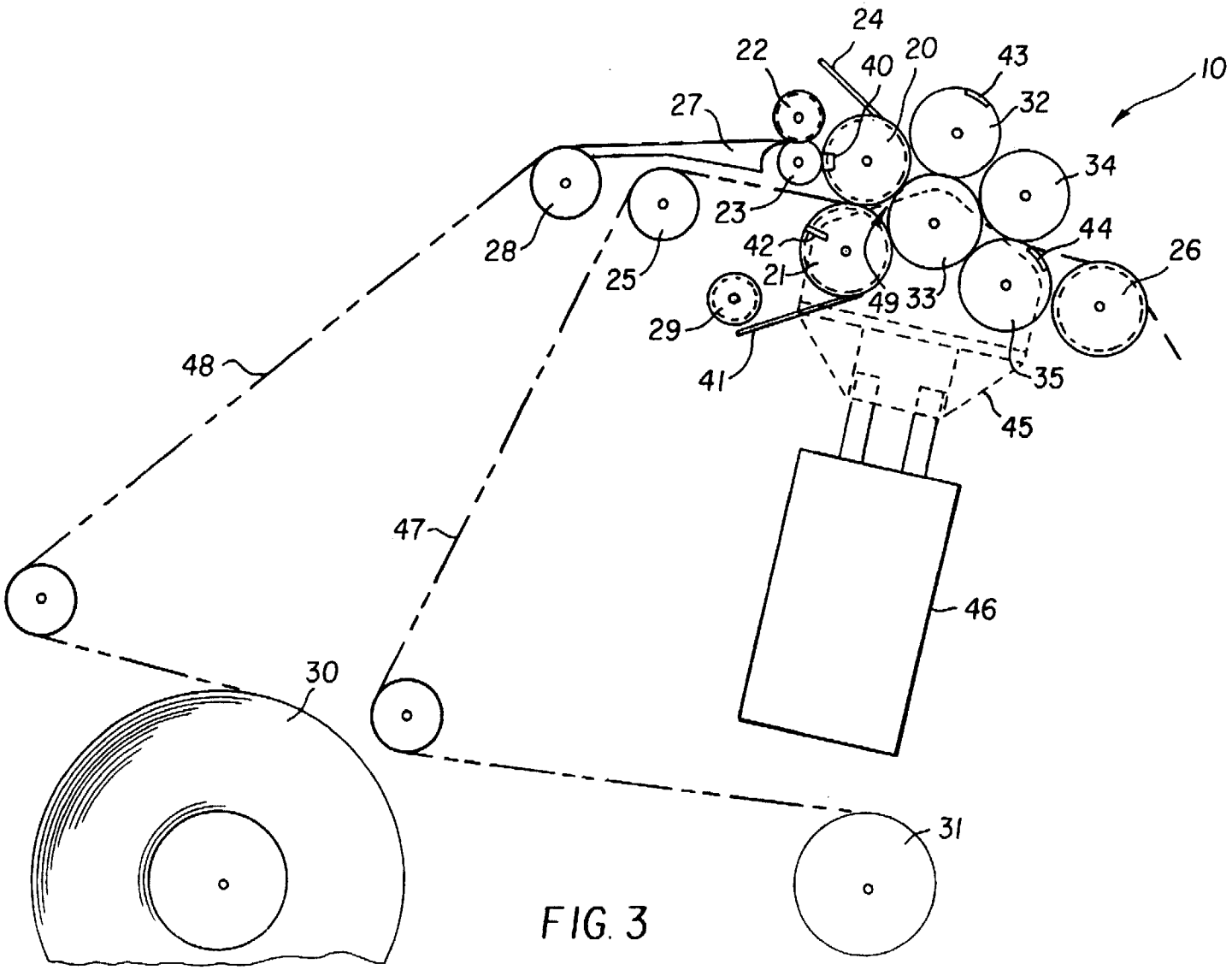
FIG. 3 is a side elevation view of the apparatus showing the upper drum assemblage and lower drum assemblage in cooperating relations for splicing.
Figure 4:
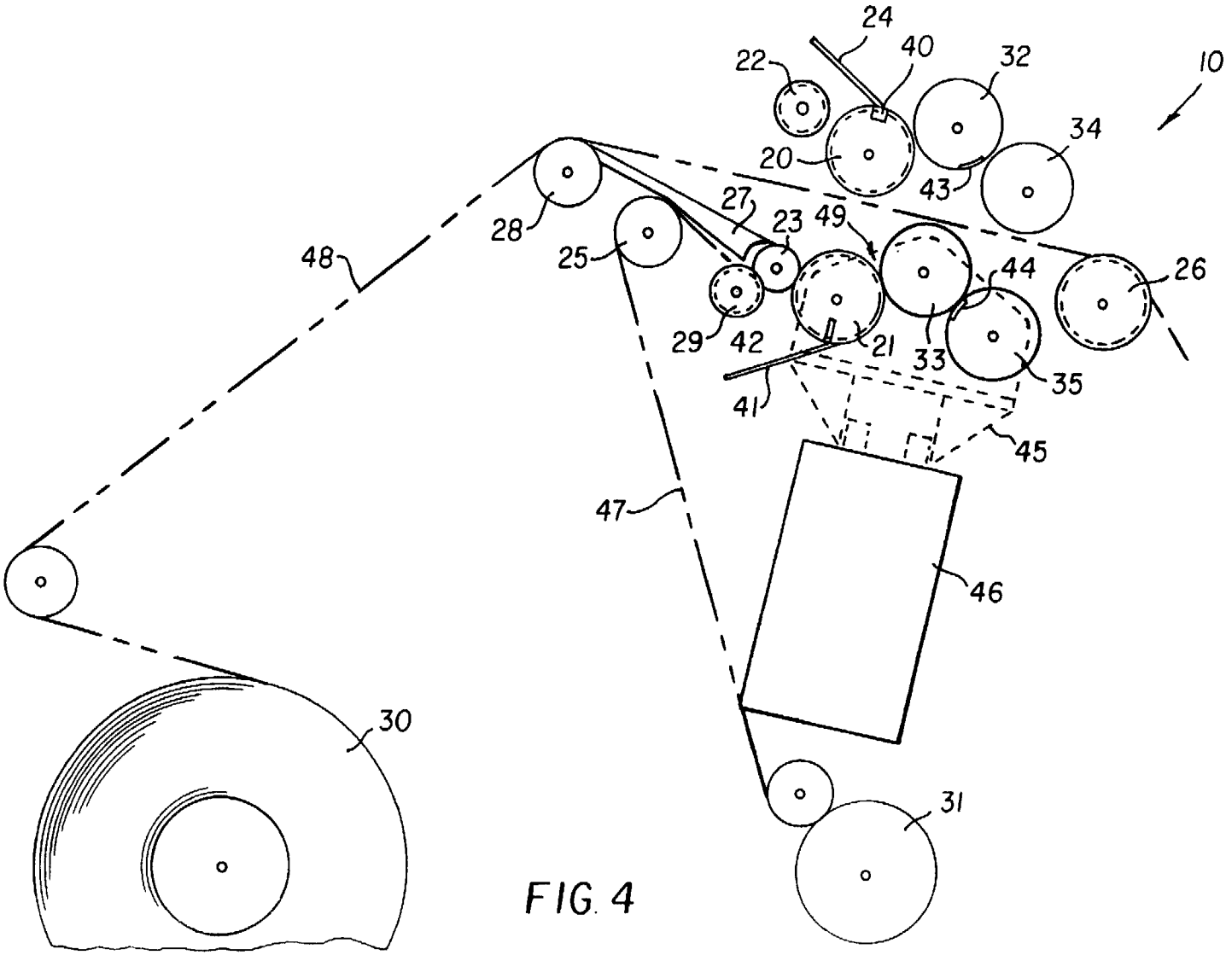
FIG. 4 is a side elevation view of the apparatus showing its position after a first splicing sequence.
Figure 5:
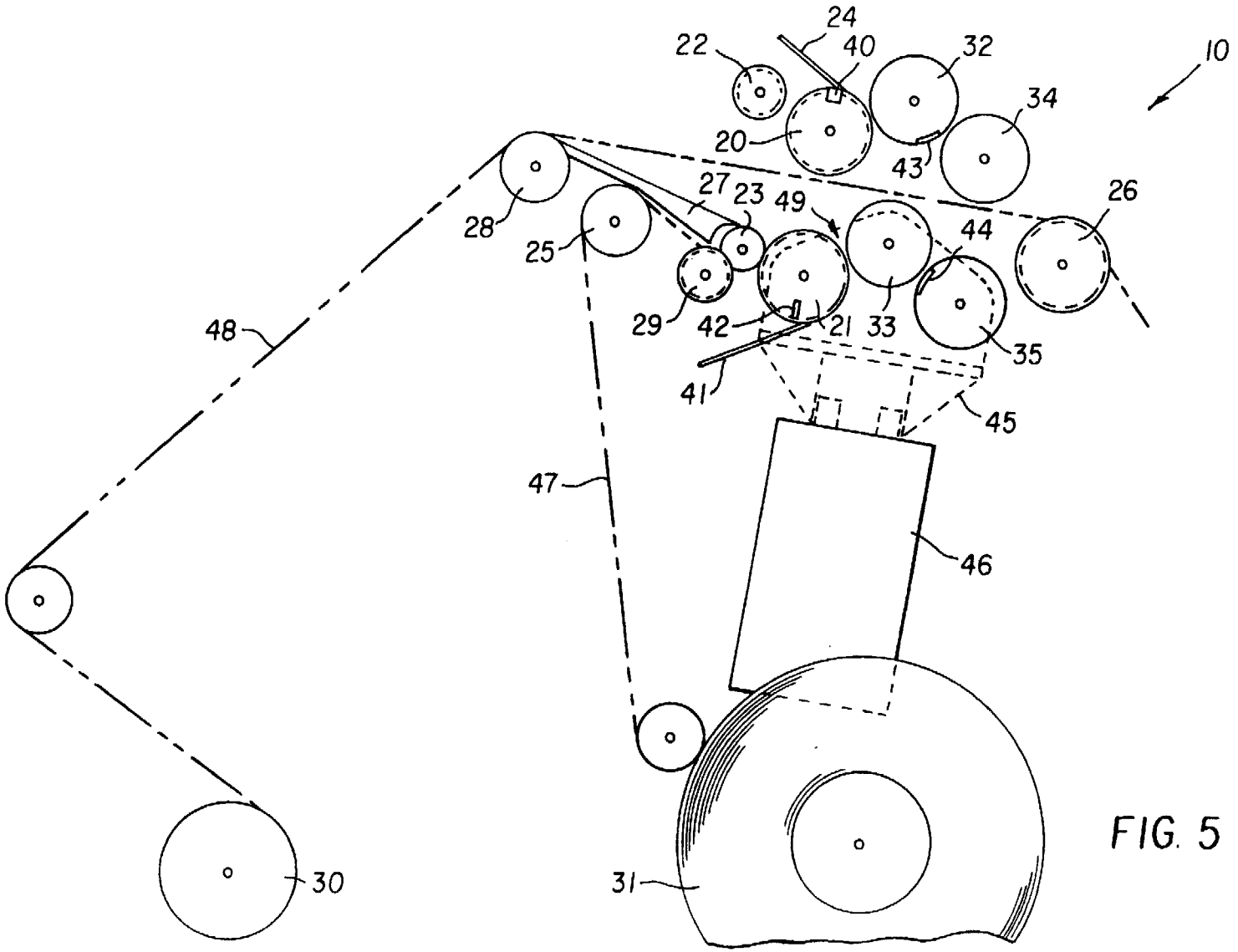
FIG. 5 is a side elevation view of the apparatus prior to initiating the second splicing sequence. Web stockroll 30 is about to expire.

Turning now to the drawings, and particularly to FIGS. 2–4, the apparatus, or web butt-splicer, 10, according to the principles of the invention is illustrated. Broadly defined the apparatus 10 for splicing a first, expiring web 47 to a second, fresh web 48, comprises first and second, ported, full circumference vacuum drums 21,20. Means for supplying the expiring web 47 to one of the first and second vacuum drums 21,20 is provided. Also, means for supplying the fresh web 48 to another of the first and second vacuum drums 21,20 is provided. In this embodiment, the expiring web 47 and fresh web 48 are sequentially transported by one of the first and second vacuum drums 21,20 at the end of a splicing cycle, as described below.

Figure 11:
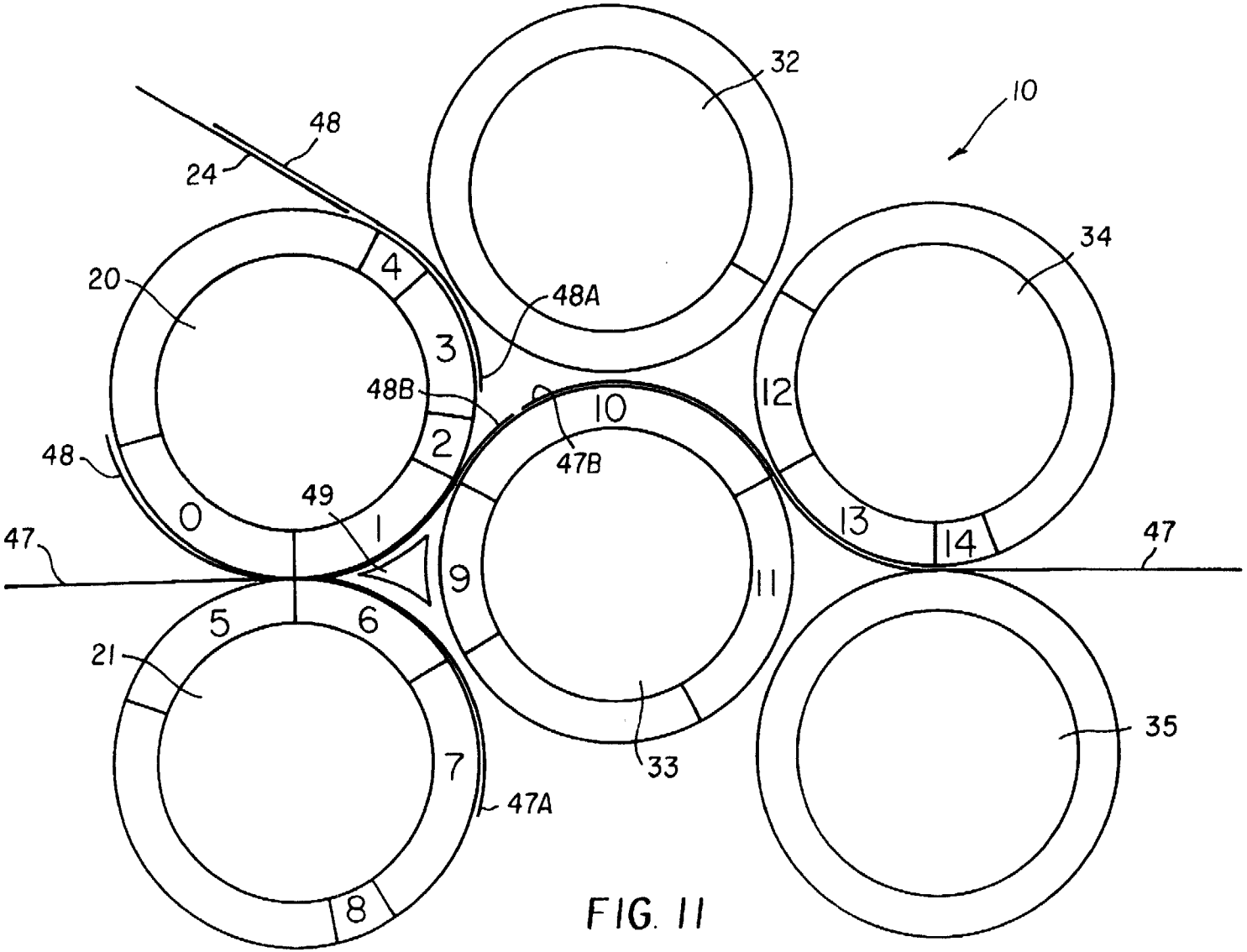
FIGS. 11 and 12 are side elevation views showing the just-cut web ends in different sequence.

A first cutting member, or knife, 40, is mounted on one of the first and second vacuum drums 21,20 in a portion of a circumference of the drum where vacuum is applied. Likewise, a second cutting member, or counter-knife, 42, capable of cooperating with the first cutting member 40 is mounted on the other of the first and second vacuum drums 21,20 in a portion of a circumference of the drum where vacuum is applied. Moreover, third, at least partial circumference and fourth, full circumference vacuum drums 32,33 are provided. Further, means for applying a first strip of splice tape to the third drum 32 and means for moving the first and second drums 21,20 into proximity to cause the first and second cutting members 42,40 to cooperate for cutting the first and second webs 47,48 between the first and second drums 21,20. In this way, a just-cut leading end 47*a* of the expiring web 47 remains with one of the first and second vacuum drums 21,20 and a just-cut trailing end 48*a* of the fresh web 48 remains with the other of the first and second vacuum drums 21,20. Further, means are provided for causing a just-cut trailing end 47*b* of the expiring web 47 and a just-cut leading end 48*b* of the fresh web 48 to transfer from drum 20 to drum 33, shown in FIG. 11. The apparatus 10 also includes means for moving the third and fourth drums 32,33 into proximity to cause the first strip of splice tape to be applied across the trailing end of the expiring web 47 and leading end of the fresh web 48, to form a spliced web.

According to FIG. 2, a first web supply stockroll 31 delivers web to a continuous running process and is guided through the splicing apparatus over web supports 25 and 26. FIG. 4 depicts a second web supply stockroll 30 delivering web to the continuous running process and is guided through the splicing apparatus over web supports 28 and 26. Web support 25 and idler roller 23 are independently attached to thread-up guide 27. Thread-up guide 27 is arranged to pivot about the center of web support 28 for urging idler roller 23 alternately into engagement with stationary idler roller 22 and idler roller 29. When thread-up guide 27 is engaged with stationary idler roller 22, threading of a new web supply stockroll 30 around drum 20 is enabled. On the other hand, when thread-up guide 27 is engaged with idler roller 29, threading of a new web supply stockroll 31 around drum 21 is enabled.

Figure 10:
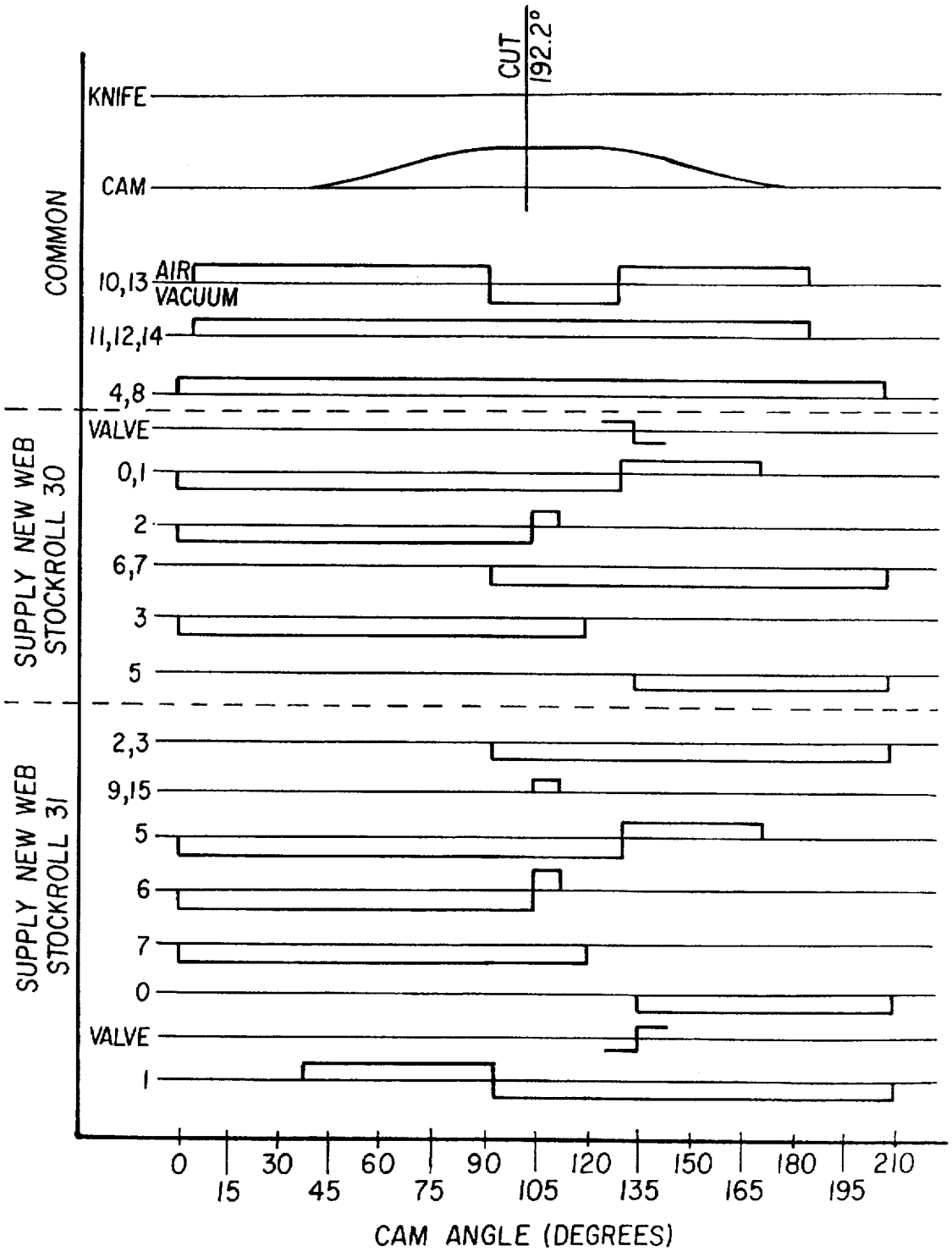
FIG. 10 is a timing diagram showing the sequencing of the ported chambers in the vacuum drums of FIG. 9.

As shown in FIGS. 3 & 4, drums 20, 32 and 34, or first drum triad, are preferably belted together for rotating in a counterclockwise direction at a common peripheral velocity. Similarly, drums 21, 33 and 35, or second drum triad, mounted for transalational movement, as described below, are preferably belted together for rotating in a clockwise direction at a common peripheral velocity substantially equal to that of drums 20, 32 and 34. A person of ordinary skill in the art will appreciate, however, that it is within the contemplation of the invention that peripheral velocities of the drums may vary and that the velocity of drums 20, 32 and 34 may be greater than or less than the velocity of drums 21, 33 and 35. When the first and second drum triads reaches a peripheral velocity equal to that, of the linear velocity of the expiring web, a cam actuated linear actuator 46 displaces block 45 supporting drums 21,33 and 35 toward stationary drums 20, 32 and 34. According to FIG. 3, the upward displacement of block 45 is synchronized with the rotation of the vacuum drums 21,33 and 35 such that the expiring web 47 does not contact drum 35 until after adhesive tape segment 44 has rotated past its engagement point with the expiring web 47. This sequence of events can be achieved with a timing sequence such as the one illustrated in FIG. 10 which shows the operations of the various components of the invention as well as vacuum and air ports. The rotational positions of the first and second drum triads are synchronized such that first cutting member, or knife, 42 cooperates with second cutting member, or counter knife, 40, to sever both the new and expiring webs 48, 47 at a common longitudinal position. By advancing the just-cut ends of webs 47,48 from the contact point of drums 20 and 21 to the contact point of drums 32 and 33, drum 32 rotates splice tape segment 43 into contact with the upper surface of the two webs 47,48 to apply o first segment of splice tape, centered over the just-cut ends of the new and expiring webs 47,48. Also, by advancing the just spliced web ends from the contact point between drums 32 and 33 to the contact point between drums 34 and 35, drum 35 rotates splice tape 44 into abutment with the underside of the new and expiring webs 47,48, centered on their freshly joined ends.

The rotational positions of the first and second drum triads are further synchronized with the downward displacement of the linear actuator 46 such that support block 45 begins to separate drums 21,33 and 35 from drums 20, 32 and 34 when drums 21,33 and 35 are in the angular positions depicted in FIG. 3. In this position, a full revolution of drums 21,33 and 35, after contacting drums 20,32, and 34, results in drums 20 and 21 separating an amount sufficient to prevent knife 42 and counter knife 40 from cooperatively engaging one another and thereby cutting the two webs 47,48 a second time.

Figure 9:
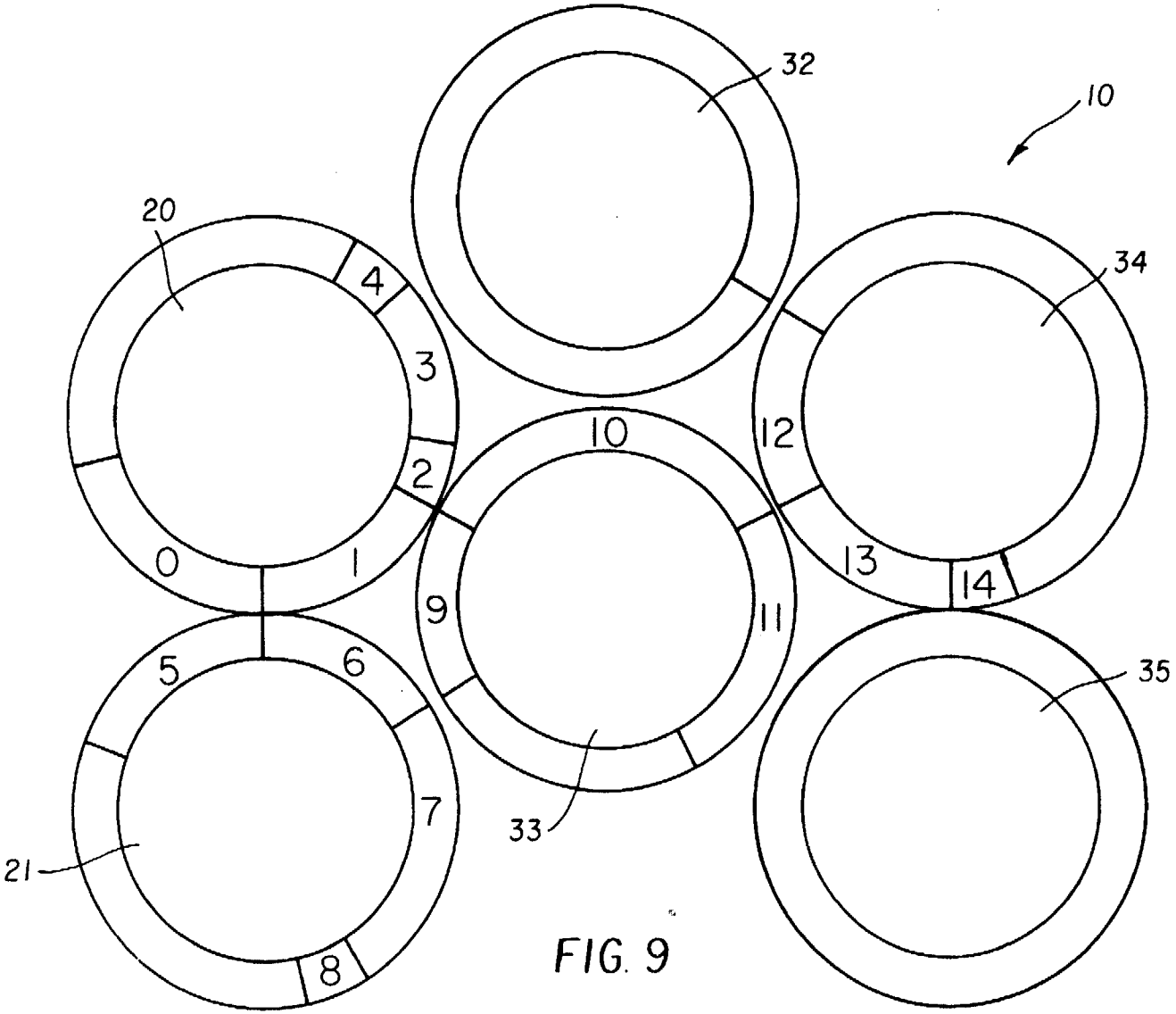
FIG. 9 is a diagrammatic side elevation view of the ported vacuum drums.
Figure 15:
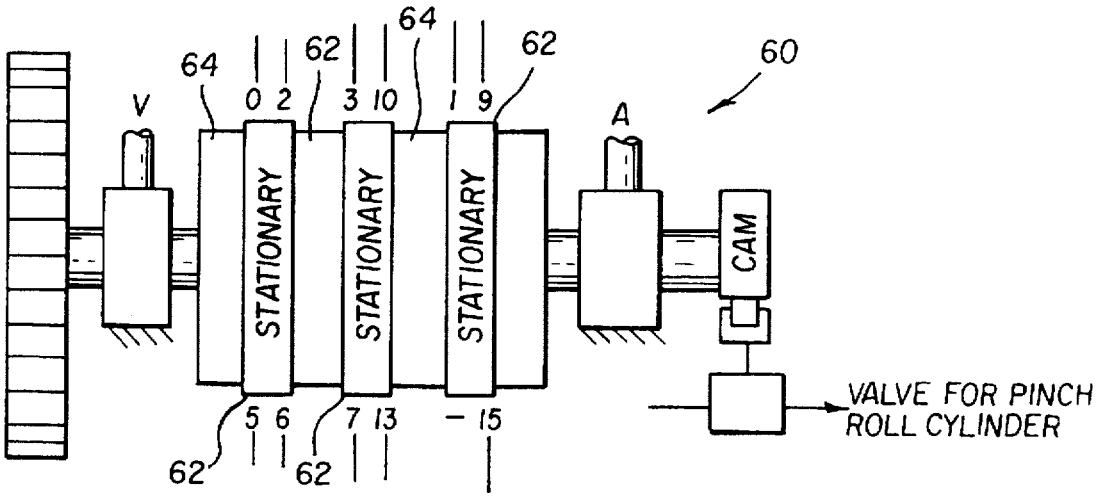
FIG. 15 is an side elevation view of the valve porting arrangement.
Figure 16A:
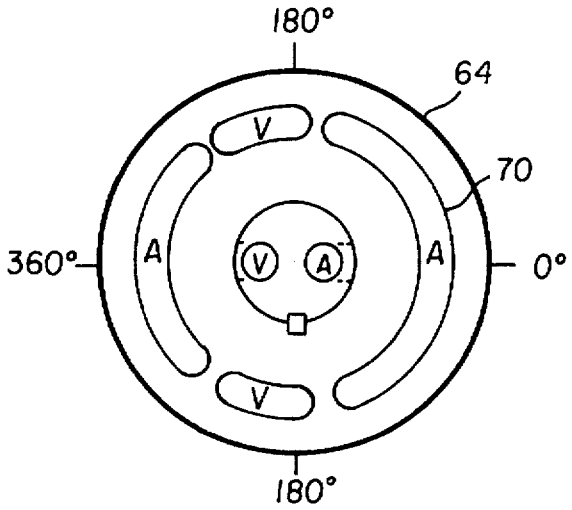
FIG. 16A and 16B are elevational end views of the rotary valve arrangement for governing the sequencing of vacuum and air porting shown in FIG. 15.
Figure 16B:
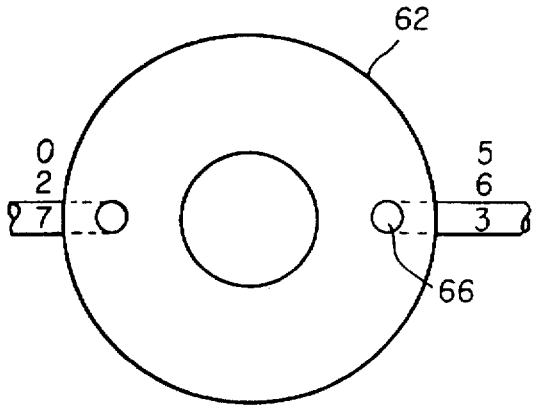

Referring again to FIGS. 2, 3, 4 and 9, drum 20 (FIG. 2) is automatically fed web from a first web supply stockroll 30 in cooperation with stationary idler roller 22 and movable idler roller 23 such that the web end is acquired by drum 20 about a portion of its periphery through the aid of vacuum ports 0,1,2 and 3 (FIG. 9). The web enters an upper scrap chute 24 (FIGS. 2–4) and remains in this position until a splice is requested. At this time, the new stockroll 30 is accelerated to match the web speed of expiring web 47 through vacuum assisted frictional contact with driven drum 20. This removes the potentially damaged outer convolutions of web from stockroll 30 and discards them into first scrap chute 24. When fresh web 48 reaches the same velocity as expiring web 47, the lower triad of drums is brought into contact with the upper drum triad, the drums being in the angular positions shown in FIG. 3 at the time of contact. An additional 80 degrees of rotation of drums 20 and 21 will bring knife and counter-knife 40 and 42 into facing alignment to sever both webs 47,48 and thus cream four just-cut web ends. Two of the web ends will be discarded and two web ends will be joined in butted alignment, as described above. Separating the two web ends to be discarded from the two web ends to be joined at high speed is accomplished by porting vacuum and compressed air to strategic segments of the various drums at the proper times. This is achieved according to a timing diagram (FIG. 10) and through, for instance, a rotary valve 60 (FIG. 15) having aligned, spatially separated stationary and rotating disks 62,64, as shown more clearly in FIG. 16. In FIG. 16, stationary disk 62 comprises at least one opening 66 for communicating air and vacuum to various ports. Further, rotating disk 64 includes at least one arcurate recess 70 communicating with sources of vacuum or compress air (not shown). Vacuum ports 6 and 7 in drum 21 will be ported to a vacuum source just before severing the webs in order to acquire the just-cut leading end of expiring web 47 and divert it around drum 21 into second scrap chute 41. Simultaneously, the freshly cut trailing end of new web 48 continues around drum 20 and into first scrap chum 24. The just-cut lead end of web 48 continues around drum 20 until reaching port 2 which has been ported to compressed air instead of vacuum at the moment the webs were cut. An air blast transfers the lead end of new web 48 from drum 20 to a portion of drum 33 supplied with vacuum from vacuum port 10 across a narrow gap shown in FIG. 11.

Figure 1:
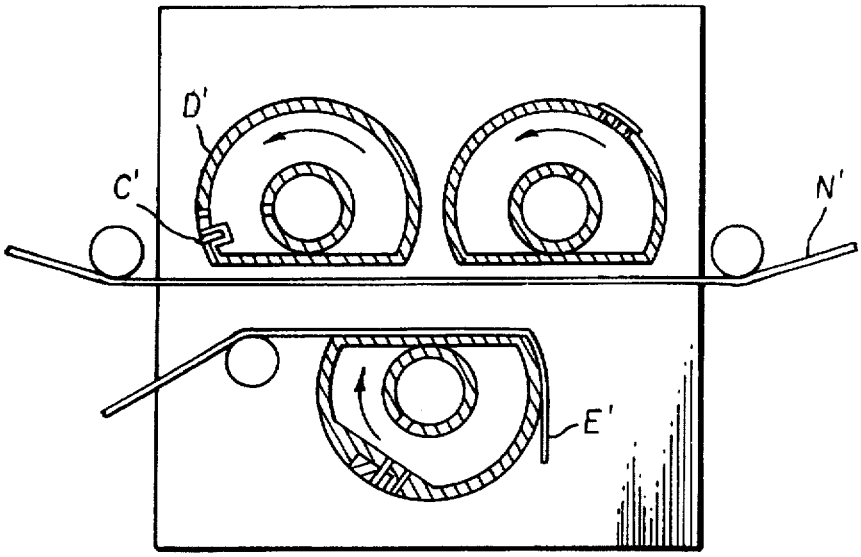
FIG. 1 (prior art)
FIG. 1 is a front elevation view of a prior art splicing apparatus.
Figure 13:
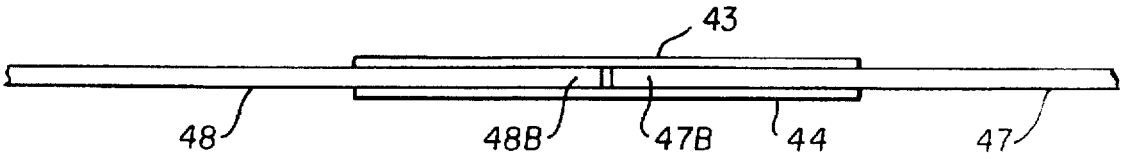
FIG. 13–14 are cross-sectional views of the abutted spliced joint formed during two different cycles.
Figure 8:
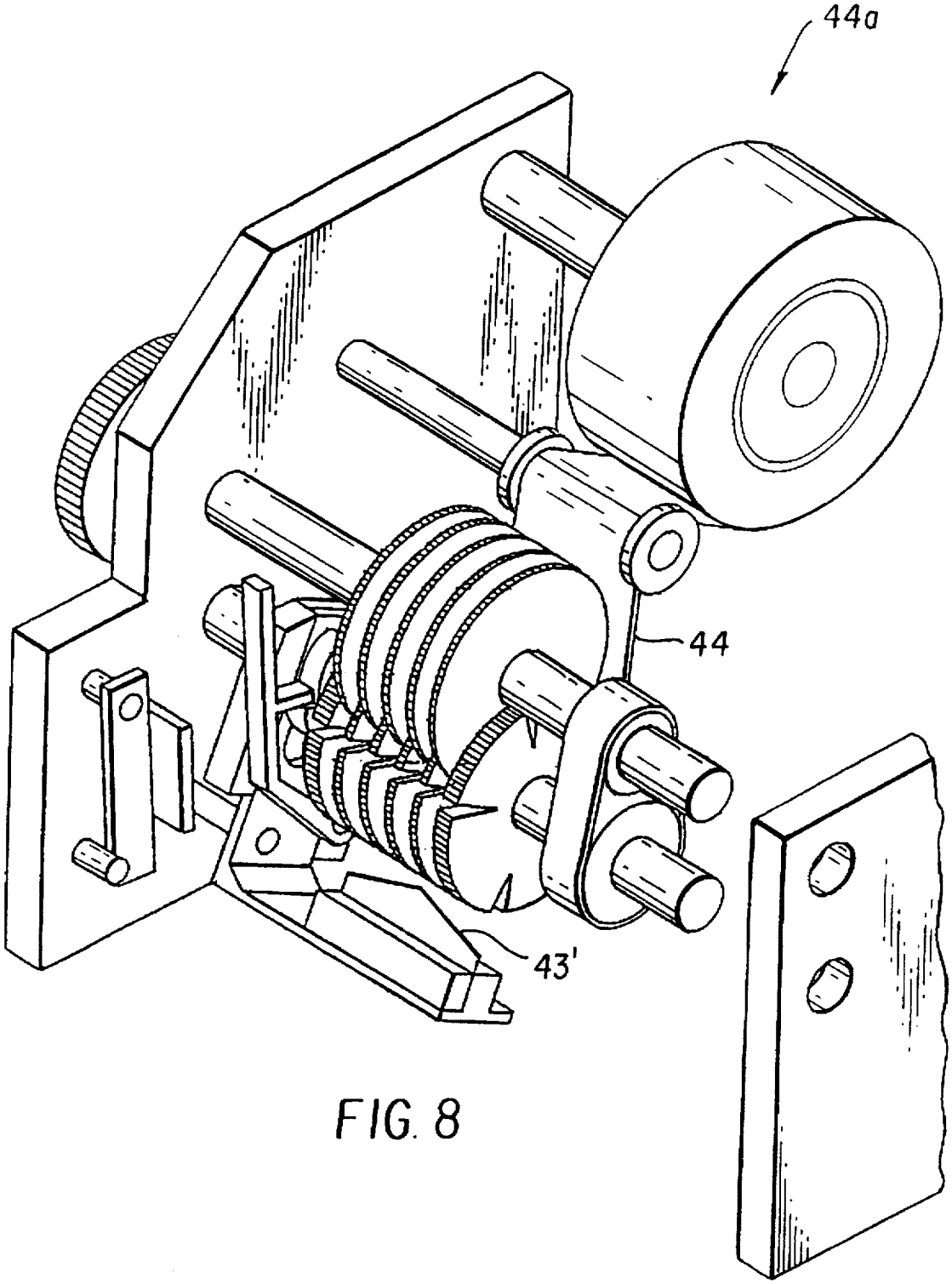
FIG. 8 is an isomeric view of an adhesive tape dispensing apparatus adapted for use with the invention.

After the two scrap web ends are removed, as described above, the just-cut trailing end **47*b* of web 47 and the just-cut leading end 48*b* of web 48 are brought into butted alignment against the surface of drum 33. A segment of splicing tape carried on drum 32 is brought into rolling contact with the two webs 47,48, centered longitudinally across one side of the just-cut web ends to form a spliced web illustrated in FIG. 13. Optionally, a second segment of splicing tape carried on drum 35 may be brought into rolling contact with the underside of the two webs, centered longitudinally across the just-cut spliced web ends (FIG. 13). Those skilled in the an will appreciate that various means of transferring tape to drums 35, 32 may be used. I prefer using a tape transfer device 44*a* having transportable tape 44 and cutting member 43'(FIG. 8), as described in U.S. Pat. No. 5,053,096, hereby incorporated herein by reference. As soon as the second segment of splice tape has been applied, the lower drum triad begins to move away from the upper triad and thread-up chute 27 begins to rotate toward idler roller 29 to deflect expiring web 47 out of the straight line path of the new web 48 across web supports 28 and 26 (FIG. 3). The vacuum drums continue to rotate in the open position, i.e., with first and second triad separated from one another, until all of expiring web 47 has been removed from the core of stockroll 31 and eliminated through scrap chute 41**.

Figure 14:
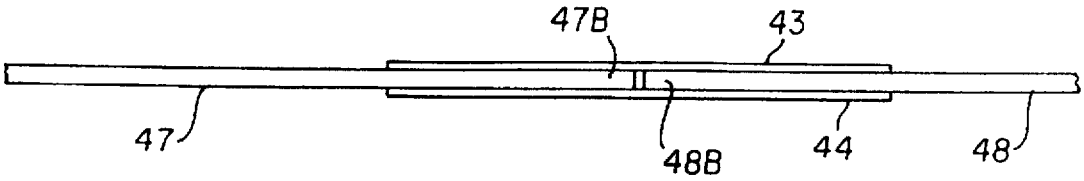
Figure 6:
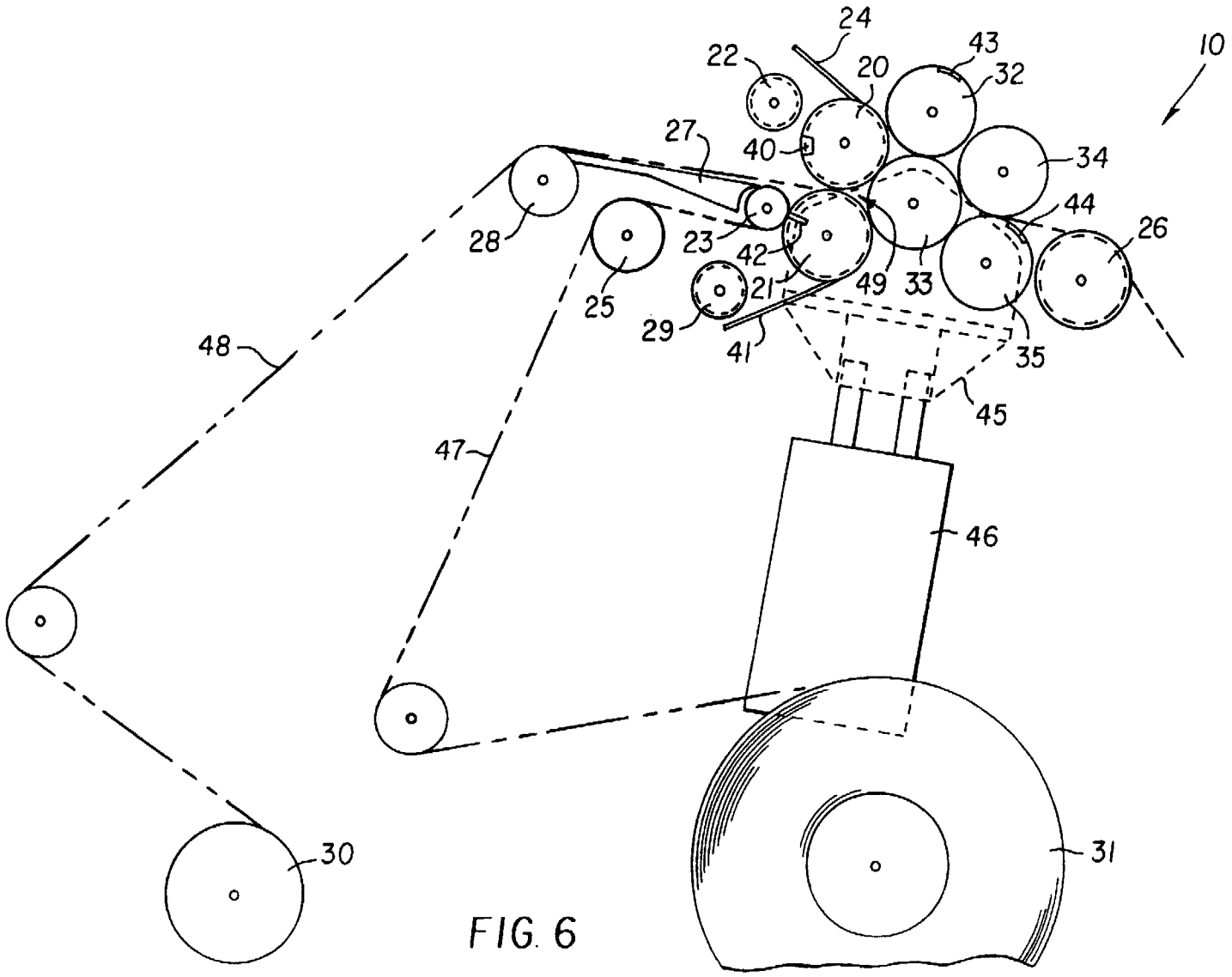
FIG. 6 is a side elevation view of the apparatus showing it position after a second splicing sequence.
Figure 7:
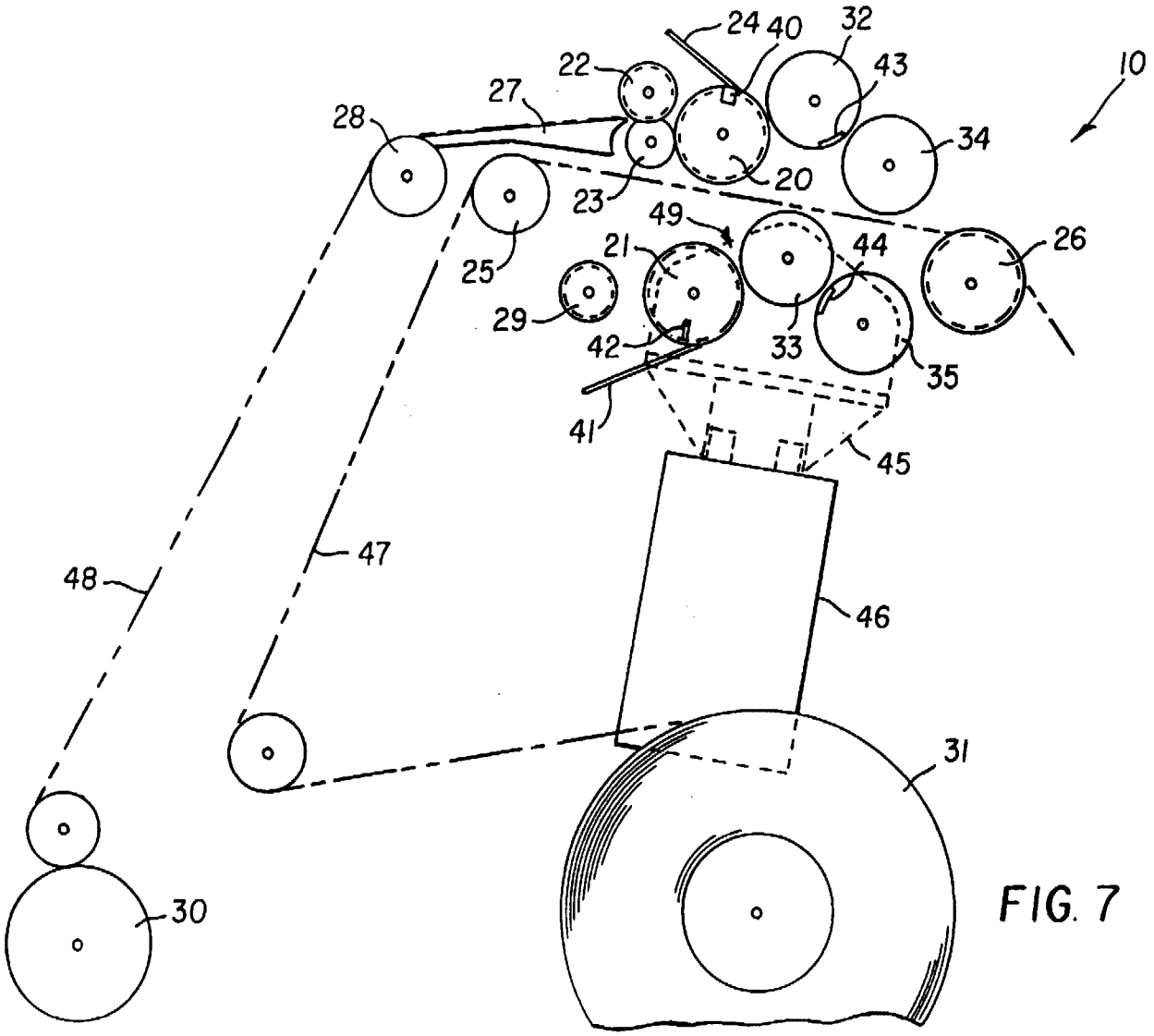
FIG. 7 is a side elevation view of the apparatus showing its position after a second splicing sequence.
Figure 12:
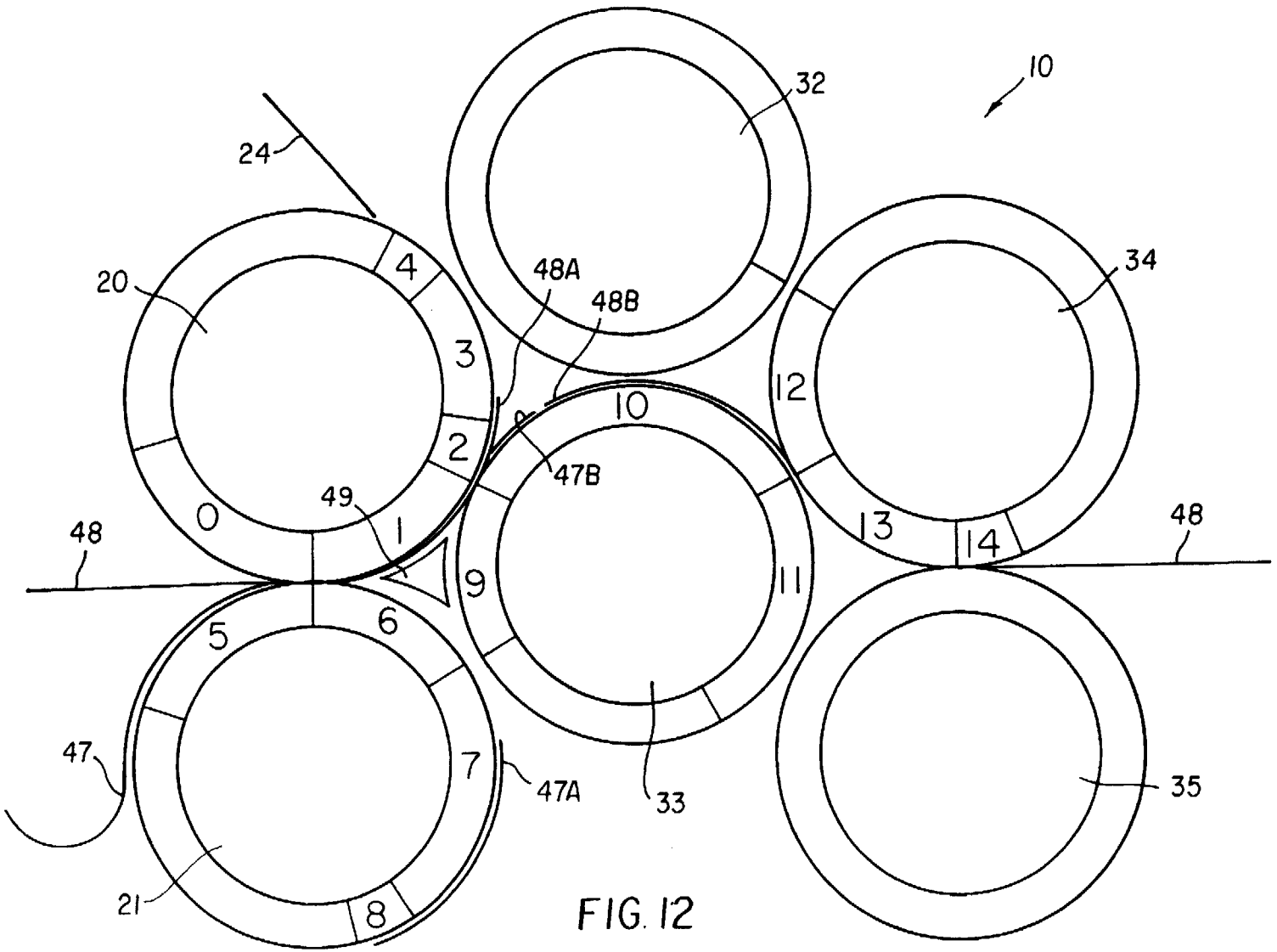

In a similar manner, referring again to FIGS. 5, 6, 7, and 9, drum 21 is automatically fed web from a second web supply stockroll 31 in cooperation with stationary idler roller 29 and movable idler roller 23. In this configuration, the web end is acquired by drum 21 about a portion of its periphery through the aid of vacuum ports 5, 6,and 7. The web enters a lower scrap chute 41 and remains in this position until a splice is requested. At this time, the new stockroll 31 is accelerated to match the web speed of the expiring web 48 through vacuum assisted frictional contact with driven drum 21. This removes the potentially damaged outer convolutions of web from stockroll 31 and discards them into second scrap chute 41. When the new web 47 reaches the same velocity as expiring web 48, the lower triad of drums is brought into contact with the upper triad, the drums being in the angular positions shown in FIG. 6 at the time of contact. An additional 80 degrees of rotation of drums 20 and 21 will bring knifes 40 and 42 into facing alignment to sever both webs and thus create four freshly cut web ends. Two web segments will be discarded and two web ends will be joined in butted alignment. Vacuum ports 1, 2,and 3 in drum 20 will be ported to a vacuum source just before severing the webs in order to acquire the just-cut leading end of expiring web 48 and divert it around drum 20 into scrap chute 24. Simultaneously, the freshly cut trailing end of new web 47 continues around drum 11 and into scrap chute 41. Vacuum port 6 in drum 11 will be ported to a source of compressed air just before severing the webs in order to divert the freshly cut leading end of new web 47 away from drum 21 toward the contact point between drums 20 and 33. We have found that an auxiliary source of compressed air or a film guide 49 is preferred at high speeds with very thin and flexible webs in order to reliably divert the film end away from drum 11 and onto the vacuum ported periphery of drum 33 in butted alignment with the just-cut trailing end of expiring web 48 (FIG. 12). Thereafter, a segment of splicing tape carried on drum 32 is brought into rolling contact with the two webs, centered longitudinally across the freshly cut web ends. Similarly, a second segment of splicing tape carried on drum 35 may be brought into rolling contact with the underside of the two webs, centered longitudinally across the freshly spliced ends (FIG. 14). As soon as the second segment of splice tape has been applied, the second drum triad begins to move away from the first drum triad and thread-tip chute 27 begins to rotate toward idler roller 22 to deflect expired web 48 out of the straight line path of the new web 47 across web supports 15 and 16 (FIG. 7). The vacuum drums continue to rotate in the open position until all of expired web 48 has been removed from the core of stockroll 30 and eliminated through scrap chute 14.

In operations, referring to FIGS. 2–4, & 9, during thread-up of a new web stockroll 30, vacuum ports 0, 1, 2, and 3 are supplied with vacuum to acquire a free end of the fresh web 48. When the expired web 47 and fresh web 44 are cut, vacuum ports 6 and 7 of vacuum drum 21 are ported to vacuum (by a valve arrangement of the type shown in FIG. 15) to adhere the just-cut leading end of the expiring web 47 to vacuum drum 21 and thus divert it into a scrap chute 41 while vacuum port 2 is switched to compressed air to divert the just-cut leading end of the fresh web 48 onto drum 33. The just-cut trailing end of the fresh web 48 adheres to vacuum drum 20 and follows it into a scrap chute 24. The just-cut trailing end of the expiring web bends around vacuum drum 20 and continues onto vacuum drum 33 (FIG. 11) where splice tape 43 is applied, joining it to the just-cut lead end of the fresh web 48 thereby forming an web butt-splice. Vacuum drum 35 applies a second length of tape 44 to the opposite side of the web butt splice (FIG. 13). After the splice, ports 5, 6, and 7 are supplied with vacuum to enable drum 21 to pull the core waste off of the right stockroll.

Vacuum ports 4, 8, 9, 10, 11, 12, 13, and 14 are not needed at low speeds and become useful only at higher web speeds, e.g., web speeds greater than about 400 ft./min.

Referring again to FIGS. 5–7 and 9, during thread-up of a new stockroll, ports 5, 6, and 7 are supplied with vacuum to acquire and accelerate the new web end. When the webs are cut, ports 6 and 7 remain ported to vacuum to retain the freshly cut trailing end of the new web and channel it into a waste chute 41. Ports 1, 2 and 3 are supplied with vacuum in order to retain the freshly cut lead end of the expiring end and divert it into a second scrap chute 24. The just-cut lead end of the new web 47 must be diverted to follow drum 20 instead of its otherwise straight line path generally toward the center of drum 33 by a blast of air from port 9 or by a diverting chute 49. The just cut trailing end of the expiring web 48 bends around drum 20 and continues onto drum 33 where splicing tape 43 is applied, joining it to the just-cut lead end of the new web 47. Drum 6 applies a second length of tape to the opposite side of the splice. After the splice has been accomplished, ports 0, 1, 2 and 3 are supplied with vacuum to enable drum 20 to pull the core waste web off of the left stockroll.

PARTS LIST

10 . . . apparatus, or web butt-splicing apparatus
31 . . . alternatingly fresh or expired web stockroll
25 . . . roller supporting web 47
47 . . . alternatingly fresh and expiring webs
48 . . . alternatingly expiring and fresh web
26 . . . exit roller supporting webs 47 and 48
28 . . . roller supporting web 48
22 . . . stationary idler roller
29 . . . stationary idler roller
23 . . . idler roller cooperates with idlers 22,29
27 . . . thread-up guide
21, 33, 35 . . . displaceable vacuum drum arrangement supporting expiring web 47
20, 32, 34 fixed vacuum drum arrangement supporting fresh web 48
46 . . . cam actuated linear actuator for displacing block 45
45 . . . support block for vacuum drums 21, 33, 35
5,6,7, 8 . . . vacuum ports of drum 21
0, 1,2, 3,4 . . . vacuum ports in drum 20
9,10, 11 . . . vacuum ports in drum 33
12,13,14 . . . vacuum ports in drum 34
40,42 . . . cutting members or knives
41 . . . second scrap chute
43 . . . splice tape segment on drum 32
24 . . . first scrap chute
44 . . . splice tape segment on drum 35
49 . . . film or web guide While our invention has been shown and described with reference to particular embodiments thereof, those skilled in the art will understand that other variations in form and detail may be made without departing from the scope and spirit of our invention.

We claim:

1. Apparatus for splicing a first, expiring web to a second, fresh web, comprising:

a first, ported, full circumference vacuum drum;

a second, ported, full circumference vacuum drum;

means for supplying the expiring web to one of the first and second vacuum drums;

means for supplying the fresh web to another of the first and second vacuum drums, said expiring web and fresh web being further transportable by either one of said first and second vacuum drums in alternating sequence after said webs are spliced;

a first cutting member mounted on one of said first and second vacuum drums in a portion of a circumference of said drum where vacuum is applied;

a second cutting member capable of cooperating with said first cutting member, said second cutting member being mounted on the other of said first and second vacuum drums in a portion of a circumference of said drum where vacuum is applied;

a third, at least partial circumference vacuum drum;

a fourth, full circumference vacuum drum;

means for applying a first strip of splice tape to the third drum;

means for moving the first and second drums into proximity to cause the first and second cutting members to cooperate for cutting the first and second webs between the first and second drums, whereby a just-cut leading end of the expiring web remains with one of the first and second vacuum drums and a just-cut trailing end of the fresh web remains with the other of the first and second vacuum drums means cooperating with said moving means for causing a just-cut trailing end of the expiring web and a just-cut leading end of the fresh web to transfer from the first drum to the fourth drum; and means for moving the third and fourth drums into proximity to cause the first strip of splice tape to be applied across the trailing end of the expiring web and leading end of the fresh web, to form a spliced web.

2. Apparatus according to claim 1, further comprising:

a fifth vacuum drum; and means for moving the fourth and fifth vacuum drums into proximity to cause the spliced web to move from the fourth to the fifth vacuum drum, thereby isolating application of the first tape strip from tension transients downstream of the fifth vacuum drum.

3. Apparatus according to claim 1, further comprising:

a sixth, at least partial circumference vacuum drum;

means for applying a second strip of splice tape to the sixth drum; and means for moving the fifth and sixth drums into proximity to cause the second strip of splice tape to be applied across the trailing end of the expiring web and leading end of the fresh web opposite the first strip.

4. The apparatus recited in claim 3 wherein said means for moving the fifth and sixth drums comprises actuating a linear actuator in synchronism with rotation of said fifth and sixth drums.

5. The apparatus recited in claim 2 wherein said means for moving said the fourth and fifth drums comprises actuating a linear actuator in synchronism with rotation of said fourth and fifth drums.

6. Apparatus according to claim 1, further comprising means for rotating the other of the first and second vacuum drums before they are moved into proximity, to remove outer convolutions from a stockroll of the fresh web.

7. The apparatus recited in claim 6 wherein said means for rotating comprises driven belt.

8. Apparatus according to claim 1, further comprising means for rotating the one of the first and second vacuum drums after they have been moved from proximity following splicing, to remove a remaining portion of the expiring web from a stockroll.

9. The apparatus recited in claim 1 wherein the means for supplying said fresh web and said expiring web to one of said first or second vacuum drums comprises a corresponding arrangement of support rollers and idler rollers positioned relative to one another so as to enable the webs to follow a substantially, fully extended path to said drums.

10. The apparatus recited in claim 1 wherein said first and second cutting members each comprises a cooperating knife and counter-knife for cutting the fresh and expired webs at a common longitudinal position along the webs.

11. The apparatus recited in claim 1 wherein said means for applying a first strip of tape comprises a detachable attached splice tape segment positioned on one of said rotatable vacuum drums which can be urged into engagement with the abutting ends of the web.

12. The apparatus recited in claim 1 wherein said means for moving said first and second drums comprises actuating a linear actuator in synchronism with rotation of said first and second drums.

13. The apparatus recited in claim 1 wherein said means for moving said first and second drums comprises actuating a linear actuator in synchronism with rotation of said first and second drums.

14. The apparatus recited in claim 1 wherein said means for moving said third and fourth drums comprises actuating a linear actuator in synchronism with rotation of said third and fourth drums.

15. A method of butt-joining webs, comprising the steps of:

providing a first and second vacuum drum for supporting the web;

providing first and second cutting members, each being mounted on said first and second vacuum drums, respectively, in a portion of the circumference where vacuum is applied;

supplying an expiring web to one of the first and second vacuum drums;

supplying a fresh web to the other of the first and second drum;

moving the first and second drums into proximity to cause the first and second cutting members to cooperate to form a just-cut leading end and a just-cut trailing end of the webs, said moving being enabled by actuating a linear actuator in synchronism with rotation of said first and second drums;

moving said trailing end of said just-cut expiring web and said leading end of said just-cut fresh web in abutting alignment for subsequent joining;

providing splicing tape for engageably joining the ends of said webs in abutting alignment;

deflecting the just cut leading end of said expiring web, and alternately deflecting the just cut trailing end of the fresh web, said respective ends of said webs being deflected away from said splicing tape so as to provide easy access to one side of the ends of the webs to be joined; and, applying a first strip of splice tape across one side of the trailing end of the expiring web and the leading end of the fresh web thereby forming a spliced web.

16. The method recited in claim 15 further comprising the step of deflecting the just cut trailing end of the fresh web, and alternately deflecting the just cut leading end of the expiring web, so as to provide easy access to an opposite side of the ends of the webs to be joined.

17. The method recited in claim 15 further comprising the step of applying a strip of tape to the opposite side of the ends of the web.

18. The method recited in claim 15 wherein the step of deflecting comprises moving the just cut trailing end of the fresh web by vacuum porting on one of said first and second drums.

19. The method recited in claim 15 wherein the steps of deflecting comprises diverting the two of the just-cut ends portions to scrap and two ends for subsequent abutting alignment.

* * * * *

IN THE UNITED STATES PATENT AND TRADEMARK OFFICE

CERTIFICATE OF CORRECTION

PATENT NO.: 5,698,060
DATED: December 16, 1997
INVENTORS: Michael Long It is certified that an error appears in the above-identified patent and that said Letters Patent is hereby corrected as shown below:

In The Claims:
Column 9, line 16, delete numerals "1" and insert a --2--.

Signed and Sealed this

Tenth Day of March, 1998

*Attest:*

*Attesting Officer*

BRUCE LEHMAN

*Commissioner of Patents and Trademarks*